United States Patent [19]

Brown

[11] Patent Number: 4,745,734

[45] Date of Patent: May 24, 1988

[54] RIDING SADDLE WITH FLEXIBLE SKIRTS

[76] Inventor: Roy L. Brown, Rte. 2, Box 132, Nevada, Mo. 64772

[21] Appl. No.: 877,115

[22] Filed: Jun. 23, 1986

[51] Int. Cl.[4] ..... B68C 1/02

[52] U.S. Cl. ..... 54/44

[58] Field of Search ..... 54/37, 44

[56] References Cited

U.S. PATENT DOCUMENTS

| | | | |
|---|---|---|---|
| 4,061 | 5/1845 | Caldwell | 54/44 |
| 1,700,792 | 2/1929 | Ernst et al. | 54/44 |
| 2,353,622 | 7/1944 | Boyle | 54/44 |
| 3,286,440 | 11/1966 | Walker et al. | 54/44 |
| 3,371,467 | 3/1968 | Salisbury, III | 54/44 |
| 3,835,621 | 9/1974 | Gorenschek | 54/44 |
| 3,872,653 | 3/1975 | Thompson | 54/44 |

FOREIGN PATENT DOCUMENTS

| | | | |
|---|---|---|---|
| 723068 | 6/1942 | Fed. Rep. of Germany | 54/44 |

*Primary Examiner*—Robert P. Swiatek

*Attorney, Agent, or Firm*—Hovey, Williams, Timmons & Collins

[57] ABSTRACT

A riding saddle is provided which distributes the weight of the horse and rider over a large surface area on the back of a horse to prevent bruising and soreing of the horse's back and to provide a shock absorbing quality as the result of their resilient, spring-like material. The saddle includes a tree frame having first and second, spaced-apart, generally parallel bars; first and second flexible skirts each having a surface area respectively greater than the surface area of lower face of the side bars; and fasteners coupling the skirts with the lower face of their corresponding bars. The skirts have flexing portions and flex to conform to the contours of the back of the horse on which the saddle is placed and are biased to return to the unflexed position when the saddle is removed from the horse. Preferably, the skirts include a layer of polycarbonate resin or plastic, a layer of foam rubber, and a layer of fleece-like material.

8 Claims, 2 Drawing Sheets

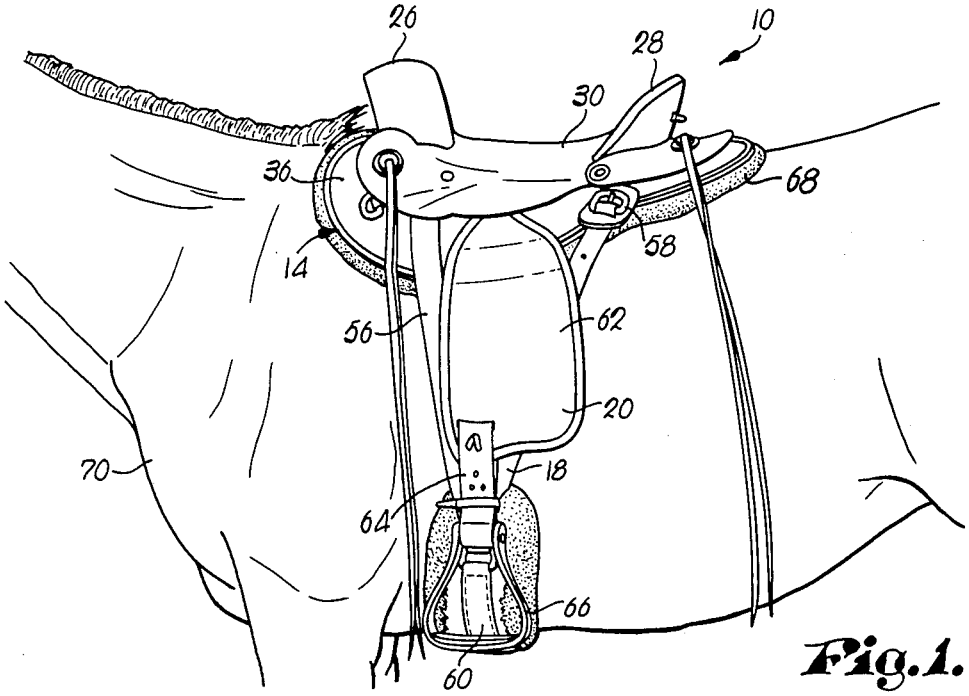
Fig.1.
Fig.4.
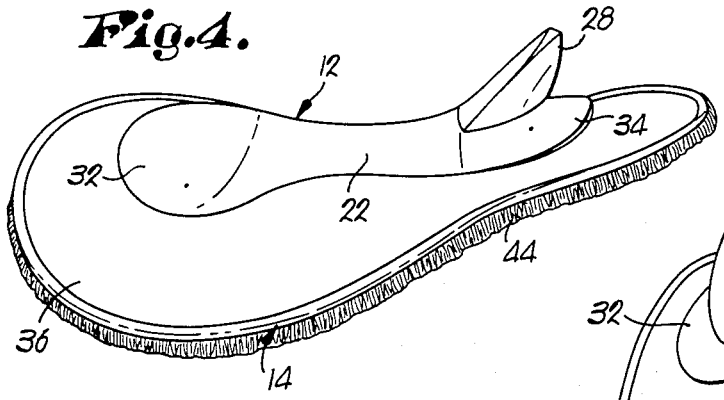
Fig.2.
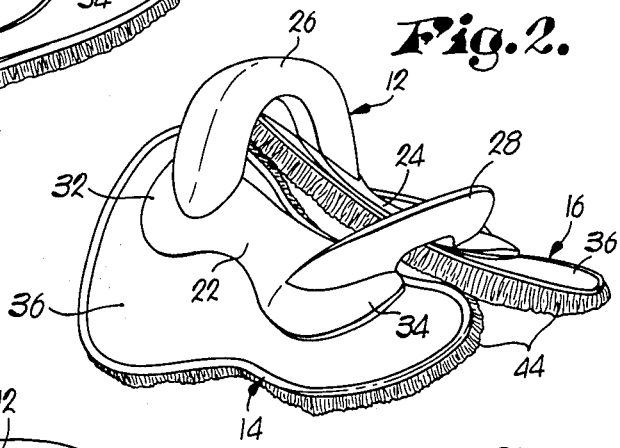
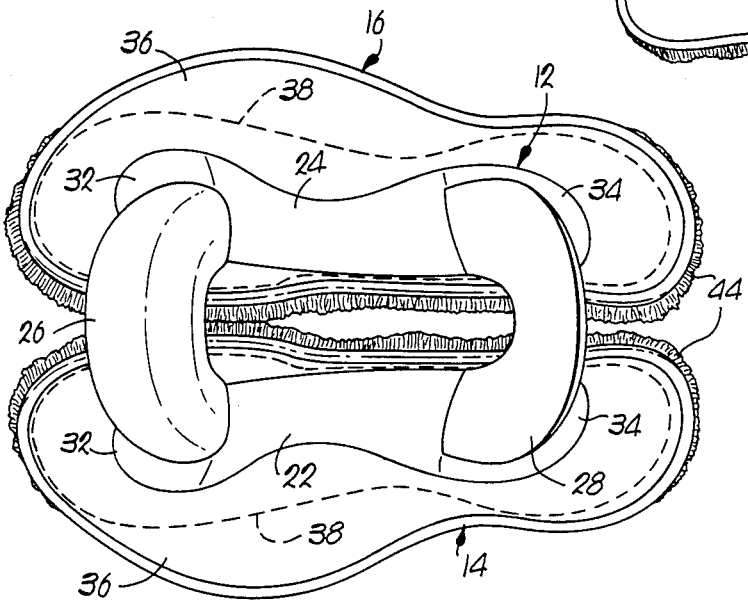
Fig.3.
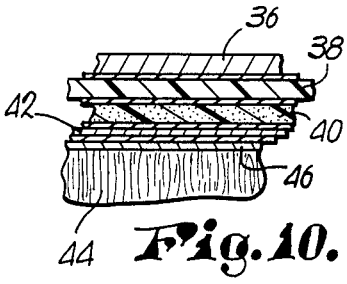
Fig.10.

Fig.6.
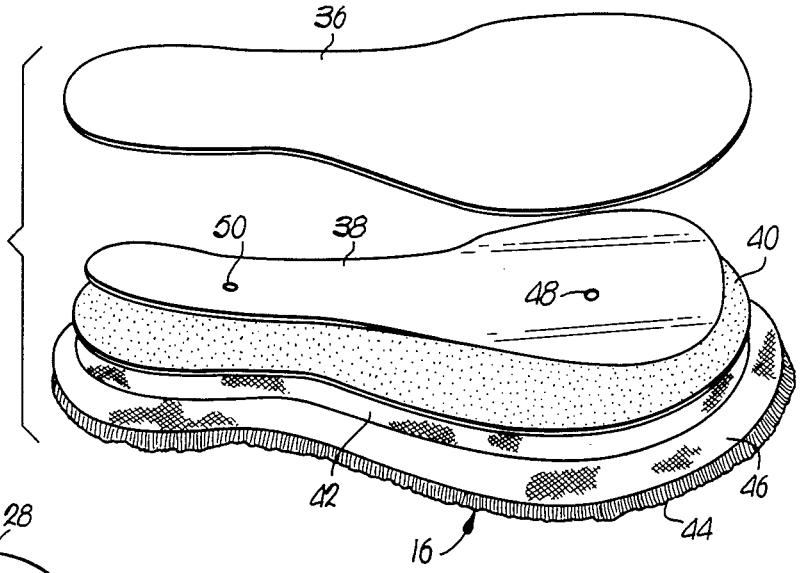
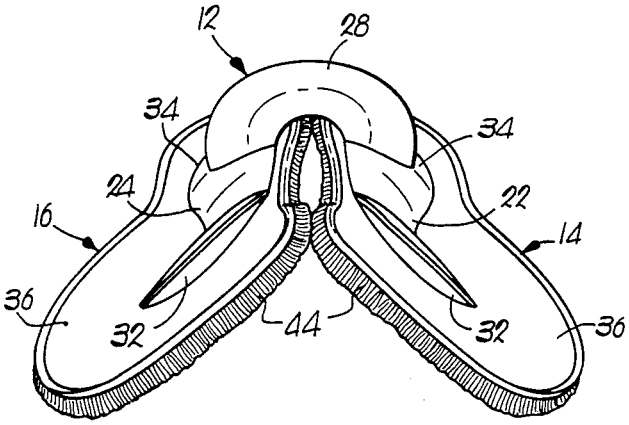
Fig.5.
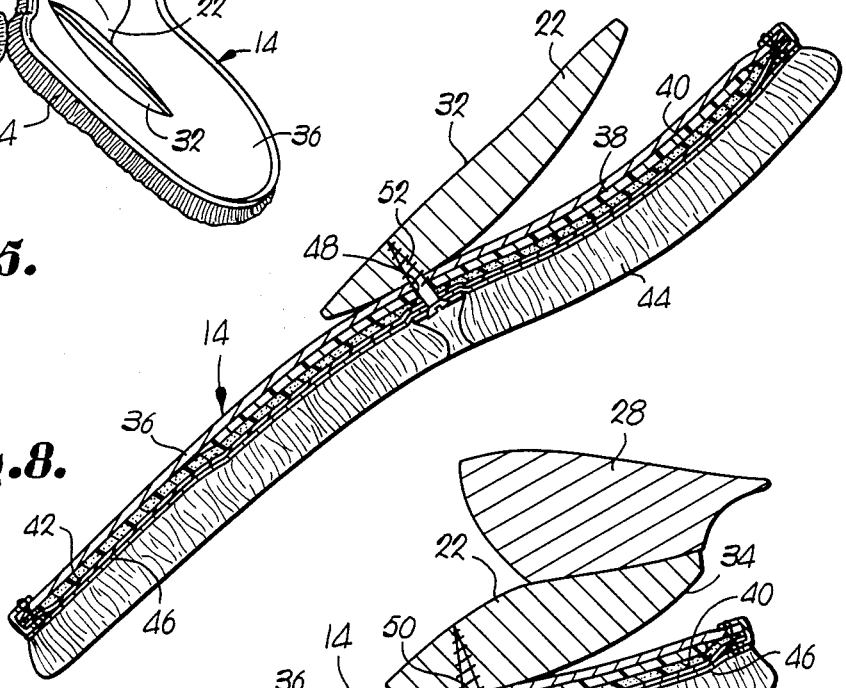
Fig.8.
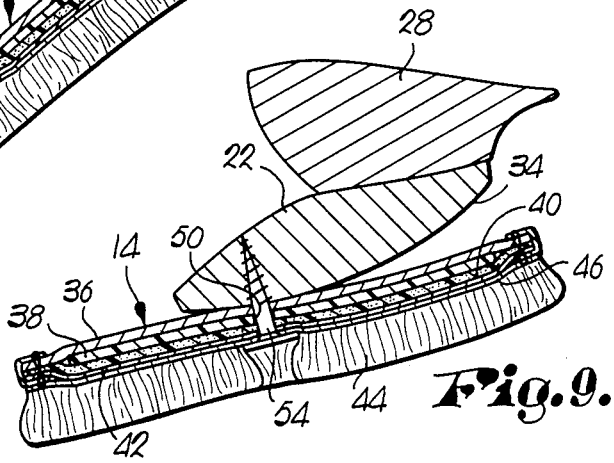
Fig.9.
Fig.7.
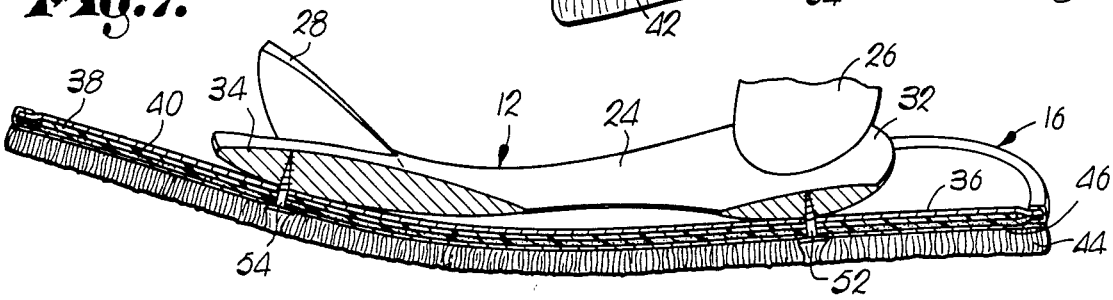

RIDING SADDLE WITH FLEXIBLE SKIRTS

BACKGROUND OF THE INVENTION

1. Field of the Invention

This invention relates to a riding saddle having a pair of flexible skirts attached under the side bars of the saddle tree, which provide for continuous, conforming, supportive contact between the saddle and the back of a horse.

2. Description of the Prior Art

Bruising and soreing of a horse's back is seemingly a perpetual problem with known prior art riding saddles, because these saddles concentrate the combined weight of saddle and rider (or pack) at a relatively few points of contact between the saddle and the back of the horse. Bruising results at these points of contact when the pressure exceeds 1½ pounds per square inch, which is the amount of pressure considered to be the maximum before bruising occurs.

For example, a typical western-type saddle includes a tree frame with two relatively straight side bars. The natural sway of a horse's back in the vicinity of the center of these bars often prevents supporting contact between the horse's back and the bars at this point. As a result, the combined weight of saddle and rider is supported at the four areas of contact in the vicinity of the forward and rearward portions of each bar. The total effective supportive contact area with this type of saddle (ill-fitting) is typically about 36 square inches, which results in about 5½ pounds of pressure per square inch of contact, for a 200 pound load well in excess of the recommended 1½ pounds per square inch. The amount of pressure exerted by the forward part of the saddle is even more concentrated because saddles are desirably designed to concentrate more of the weight at the forward end of the saddle to be more directly over the horse's front legs. The bruising problem is particularly aggravated when the horse is under saddle for long periods of time over rough terrain. These conditions commonly occur during competitive endurance riding.

Numerous prior art devices have attempted to solve the bruising and soreing problem. For example, U.S. Pat. No. 3,286,440 to Walker, et el. provides a lightweight, rigid saddle. This saddle, however, does not specifically conform to the shape of a horse's back and as a result the weight of the rider and saddle may be distributed to only a few points of contact, depending upon the shape of the individual horse's back. Even though the saddle is designed to be lightweight, this does nothing to lessen the weight of the rider or distribute the weight evenly over the surface of the horse's back.

U.S. Pat. No. 3,371,467 to Salisbury provides for a custom, molded fiberglass, reinforced saddle. This saddle evenly distributes the weight of the rider and saddle over the back of the horse when the horse is at rest, however, the saddle does not flex to conform to the continuously changing configuration of the horse's back as it is moving. That is, the shoulders of the horse change shape as the horse moves and inasmuch as the weight of the rider and saddle tend to be concentrated at the forward end of the saddle, on the sides of the withers, the bruising and soreing problem continues. Secondly, a custom made saddle is very expensive and is not effective for use on a different horse nor even for the particular horse for which it was designed if the horse loses or gains weight.

U.S. Pat. No. 2,353,622 to Boyle provides for rigid contact plates supported by ball and socket joints at the front and rear of each rail of the saddle. These contact plates do not flex and are unable to continuously conform to the changing shape of the horse's back as it moves. Additionally, the individual plates are not intended to flex in order to conform to the shape of the horse's back.

U.S. Pat. No. 3,835,621 to Gorenschek provides for a flexible saddle tree in which the entire saddle is flexible. The invention of the Gorenschek patent requires that the tree frame on the saddle itself be flexible and does not allow for a standard rigid tree frame to be adapted for flexible conforming fit with the back of a horse. That is to say, the Gorenschek invention cannot be used with a saddle having a rigid tree frame.

SUMMARY OF THE INVENTION

The problems outlined above are solved by the riding saddle made in accordance with the present invention. That is to say, the saddle distributes the combined weight of saddle and rider over a large surface area on a horse's back to reduce the pressure per square inch to prevent bruising and soreing. Additionally, the saddle flexibility maintains the large surface area of contact even as the contour of the horse's back changes during movement.

Broadly speaking, the saddle includes a tree frame having a pair of spaced apart, generally parallel side bars; a pair of flexible skirts attached to the bars with each skirt having a surface area greater than the surface area of the bars; and means coupling the skirts to the lower side of the bars. Each skirt is biased toward an unflexed position and has a flexed position when the saddle is placed on a horse whereby the skirts are in supportive contact with the back of the horse and continuously, yieldably conform to the contours thereof.

More particularly, the coupling means provides for a point of contact between the forward and rearward section of each bar and each skirt respectively. Preferably, the skirts include a resilient plastic or similar material and foam rubber.

BRIEF DESCRIPTION OF THE DRAWINGS

FIG. 1 is a side elevational view of the saddle in place on a horse.

FIG. 2 is a perspective view of a tree frame including a pair of skirts attached thereto;

FIG. 3 is a top plan view of the tree frame with attached skirts;

FIG. 4 is a side elevational view of the tree frame with an attached skirt;

FIG. 5 is a front elevational view of a tree frame with attached skirts shown and with the pommel removed;

FIG. 6 is a exploded view of a skirt;

FIG. 7 is a side elevational, partially fragmentary view of a tree frame with an attached skirt, portions being in section;

FIG. 8 is a front elevational view of a bar with an attached skirt, portions being in section;

FIG. 9 is a partial sectional view of a bar with an attached skirt;

FIG. 10 is a fragmentary sectional view of a skirt, showing the laminations thereof,

DESCRIPTION OF THE PREFERRED EMBODIMENT

Saddle 10 broadly includes tree frame 12, left skirt 14, right skirt 16, girth rigging 18, and two fenders 20.

Tree frame 12 includes left bar 22, right bar 24, pommel 26, cantle 28, fiberglass coating (not shown) and leather covering 30. Bars 22, 24 are spaced apart and generally parallel and are adapted for disposition on opposed sides of the horse's backbone when in use. Additionally, each rail 22, 24 includes forward section 32 and rearward section 34. Lateral and longitudinal cross sectional views of sections 32 and 34 present generally arcuate configurations.

Pommel 26 is configured to present a yoke or fork and is fixedly attached near the forward ends of bars 22 and 24. As a matter of designer's choice, pommel 26 can be equipped with a roping horn as is commonly desired for western-type saddles. Cantle 28 is fixedly attached near the rearward ends of bars 22 and 24 and is configured to present a seat rest for a rider. Bars 22, 24, pommel 26, and cantle 28 are composed of hardwood, preferably southern pine.

Desirably, a layer of fiberglass overlays the tops of bars 22 and 26 and spans the gap therebetween to provide a firm base for covering 30. Leather covering 30 is fitted to cover the top of saddle 10 including cantle 28 and includes various customary saddle trappings.

Skirts 14 and 16 are composed of laminated layers and include leather upper layer 36, KYDEX synthetic resin material 38, foam rubber 40 with intregal nylon backing 42 and lower fleece covered layer 44 including intregal backing fabric 46.

Layer 38 is strong, flexible, and is inherently biased toward its molded configuration. Layer 38 of skirt 14 is preferably molded to present a slight left-hand helical twist about its longitudinal axis. Layer 38 of skirt 16 (FIG. 6) presents a slight right-hand helical twist.

KYDEX synthetic resin material is the preferred structure of layer 38 because it is very strong yet flexible and returns to its molded, unflexed configuration when flexing forces are removed. Note that the length and width of each of the plastic layers 38 are somewhat less than the corresponding dimensions of the other layers of skirts 14 and 16, as illustrated by phantom lines in FIG. 3. The smaller size of layer 38 causes the flexibility of skirts 14 and 16 to vary directly as a function of the distance from its longitudinal axis.

Layers 36–46 are laminated together using conventional glueing techniques. Layers 36–42 are bound around all raw edges by nylon ribbon or seam binding and sewn in place. Layer 44 is glued to the underside of this combination and sewn to layers 36–42.

Forward attachment screw 52 is received through skirt 14 via forward attachment hole 48 and is threadably received in forward section 42 of left bar 22. Rearward attachment screw 54 is received through skirt 14 via rearward attachment hole 50 and is threadably received in rearward section of 34 of skirt 14. Skirt 14 is thus fixably secured to left side bar 22 at two points of contact. With this configuration, left skirt 14 is free to flex about left side bar 22 restrained only by the two points of contact - screws 52 and 54. Forward and rearward attachment screws 52 and 54 similarly attach right skirt 16 to right bar 24 at sections 32 and 34 (FIGS. 2, 3, and 5).

Girth rigging 18 includes two rigging straps 56. The ends of straps 56 are attached to tree frame 12 on opposed sides of saddle 10 near the forward end thereof. Buckles 58 are attached to tree frame 12 on opposed sides of saddle 20 near the rearward end thereof. Saddle straps 56 are passed through and slidably received by a roller loop (not shown) included at both ends of girth 60. Straps 56 are typically adjusted by buckle 58 according to the barrel of the particular horse. Girth rigging 18 allows girth 60 to move front to back somewhat even while snugly engaged to provide a more comfortable fit. Additionally, this arrangement eliminates excessive bulk from the sides of the horse which allows closer contact between the rider's legs and the horse's sides and contributes to overall rider and horse comfort.

Stirrup assemblies 20 each include a fender 62, a stirrup strap 64, and stirrups 66. The tops of fenders 62 are secured to stirrup strap 64. Looped, adjustable, stirrup straps 64 are respectively secured to tree frame 12 on opposed sides of saddle 10. Attached to the ends of straps 64 are cam lock buckles (not shown) which respectively receive the opposite ends of straps 64 in whose loop rest stirrups 66 when the cam-lock buckle is engaged. Stirrup straps 64 are preferably made of BIOTHANE nylon impregnated polyurethane which allows for some flexibility and shock absorbing capability of straps 64. Stirrups 66 are preferably composed of a high strength synthetic resin material which also flexes somewhat to provide additional shock absorbing capability.

To use saddle 10, an appropriate saddle pad 68 is first placed on the back of a horse 70. Pad 68 preferably has sufficient width to allow the center of pad 68 to be tucked up into the gullet of saddle 10 between skirts 14 and 16. This insures that pad 68 is not tightly stretched across the backbone of horse 70 which would cause excessive pressure to the horse's backbone.

Saddle 10 is then palced on pad 68 and girth 60 is snugly cinched to hold saddle 10 securely in place. The loins of horse 70 which receive the rearward portion of skirts 14 and 16, are typically more horizontal than the withers which support forward portions of skirts 14 and 16. Because of this, the left-hand and right-hand twists of skirts 14 and 16 allow the skirts to generally conform to the configurations of the horse's back as the saddle is initially placed.

As girth 60 is tightened, skirts 14 and 16 flex to conform even more specifically. That is to say, the forward portions of skirts 14 and 16 generally flex upwardly and somewhat outwardly to conform to the horse's withers and shoulders. The rearward portions of skirts 14 and 16 flex upwardly to conform to the horse's loins. The side portions of skirts 12 and 14 inboard of attachment screws 52 and 54 flex to conform to the typical sway in this region of the horse's back. Additionally, the outboard portions of skirts 12 and 14 flex to conform to the barrel of horse 70

As seen in FIG. 3, the surface area of skirts 14 and 16 is considerably larger than the surface area of bars 22 and 24. In the preferred embodiment, each skirt provides about 200 square inches of contact with the horse's back compared to 36 square inches typical in an ill-fitting saddle earlier described. With this amount of surface area, the distributed weight on a horse's back is about 0.5 pounds per square inch for a combined saddle and rider weight of 200 pounds. This amount is well under the 1.5 pounds per square inch recommended maximum to prevent bruising. This result is a startling improvement when compared to the typical 5.5 pounds per square inch exerted by a typical ill-fitting production saddle as discussed above in connection with the prior art.

As best illustrated in FIG. 3, the shape of skirts 14 and 16 provides more bearing surface in the forward portions thereof. In typical saddle design, it is desirable to place more weight toward the forward part of the saddle in order to place more weight over the shoulders of the horse. The shape of skirts 14 and 16 takes this in to account by providing greater bearing surface where the greater weight is supported thus insuring even distribution over the entire bearing surface of skirts 14 and 16. In this way, skirts 14 and 16 prevent the forward sections 32 of bars 22 and 24 from digging into the shoulders of the horse as is typical with conventional production saddles.

Additionally, the flexible nature of skirts 14 and 16 allows the skirts to move and flex as the configuration of a horse's back changes while the horse is moving. Furthermore, each skirt 14, 16 individually flexes independent of the other to closely conform to the changing configuration of the horse's shoulders and loins as it moves.

Finally, skirts 14 and 16 return to their original configuration when saddle 10 is removed from the horse. This is due to the nature of layer 38 which returns to its original configuration when flexing stresses are removed. This prevents skirts 14 and 16 from permanently molding themselves to the contours of a particular horse over time. This unique aspect of a saddle 10 allows it to be advantageously used on a variety of horses having distinctly differing shapes.

Having described in detail the preferred embodiment of the present invention, what is claimed as new and desired to be secured by Letters Patent is:

1. A riding saddle for placement on a horse for supporting a rider thereon, said saddle comprising:

a tree frame including a pair of laterally spaced-apart forward sections each presenting a first effective surface area and a forward contact zone smaller than the first effective surface area on the underside thereof;

first and second flexible, resilient, laterally spaced-apart skirts each formed of material giving the skirt an initial shape which can be flexed during use of the saddle, with the skirt returning to its initial unflexed shaped when flexing forces are relieved, each of said skirts further including an enlarged forward portion presenting a second effective surface area and being configured to overlie a respective withers section of a horse on which the saddle is placed, said tree frame being located in superposed relationship to said skirts with said forward contact zones of said forward sections of said tree frame in engagement with a corresponding enlarged forward portion of a skirt therebeneath, the second effective surface area of each of said skirts being larger than and extending outwardly and forwardly of the adjacent first effective surface area presented by said tree frame forward section thereabove; and means for effecting a substantially rigid connection between said forward contact zone of each tree frame forward section and the corresponding skirt forward portion, there being substantial clearance between the underside of each tree frame forward section surrounding said contact zone and the adjacent portion of the corresponding skirt therebeneath, for permitting substantial flexing of each skirt relative to said tree frame during use of the saddle.

2. The saddle as set forth in claim 1, said skirts together having a total lower surface area such that the weight of the rider and saddle together present no more than an average weight of $1\frac{1}{2}$ pounds per square inch of said lower surface area.

3. The saddle as set forth in claim 1, said average weight being equal to about one-half pound per square inch.

4. The saddle as set forth in claim 1, said tree frame including a pair of laterally spaced-apart rearward sections each presenting a third effective surface area and a rearward contact zone smaller than the said third effective surface area on the underside thereof, each of said skirts further including an enlarged rearward portion presenting a fourth effective surface area and being configured to overlie a respective loins section of a horse on which the saddle is placed, each of said rearward contact zones being in engagement with a corresponding enlarged rearward portion of a respective skirt therebeneath, said fourth effective surface area of each of said skirts being larger than and extending outwardly and rearwardly of the adjacent third effective surface area presented by said tree frame rearward section thereabove, said saddle further including means for effecting a substantially rigid connection between said rearward contact zone of each of said tree frame rearward sections and the corresponding rearward skirt portion, there being substantial clearance at the underside of each tree frame rearward section surrounding said rearward contact zone and the adjacent rearward portion of the corresponding skirt therebeneath, for permitting substantial flexing of each skirt rearward portion relative to said tree frame during use of the saddle.

5. The saddle as set forth in claim 4, said second effective surface area of each of said skirt forward portions being larger than the corresponding fourth effective surface area of said skirt rearward portions.

6. The saddle as set forth in claim 4, each of said skirts presenting a longitudinal twist such that each of said forward portions is presented at an angle generally corresponding to the angle of the horse's withers and shoulders relative to said saddle, and such that each of said rearward portions is presented at an angle generally corresponding to the angle of the horse's loins relative to said saddle.

7. The saddle as set forth in claim 1, each of said skirts presenting a lower surface area of about 200 square inches.

8. The saddle as set forth in claim 1, each of said skirts including resilient synthetic resin material.

* * * * *